United States Patent [19]

Letsche

[11] Patent Number: 4,930,464

[45] Date of Patent: Jun. 5, 1990

[54] HYDRAULICALLY OPERATING ACTUATING DEVICE FOR A LIFT VALVE

[75] Inventor: Ulrich Letsche, Stuttgart, Fed. Rep. of Germany

[73] Assignee: Daimler-Benz AG, Stuttgard, Fed. Rep. of Germany

[21] Appl. No.: 413,212

[22] Filed: Sep. 27, 1989

[30] Foreign Application Priority Data

Oct. 28, 1988 [DE] Fed. Rep. of Germany ..... 3836725

[51] Int. Cl.[5] ..... F01L 9/02

[52] U.S. Cl. ..... 123/90.12; 92/131; 251/31; 91/420

[58] Field of Search ..... 123/90.12, 90.13; 91/420; 92/131; 251/31, 30.01

[56] References Cited

U.S. PATENT DOCUMENTS

| | | | |
|---|---|---|---|
| 3,068,898 | 12/1962 | Meddock | 251/31 |
| 3,209,737 | 10/1965 | Omotehara et al. | 123/90.12 |
| 3,361,121 | 1/1968 | Schott | 123/90.13 |
| 3,844,528 | 10/1974 | Massie | 251/31 |
| 3,872,844 | 1/1975 | Gates | 123/90.13 |
| 4,014,509 | 3/1977 | Yoshino et al. | 251/31 |
| 4,200,067 | 4/1980 | Trenne | 123/90.13 |
| 4,287,812 | 9/1981 | Iizumi | 91/420 |
| 4,361,075 | 11/1982 | Block | 91/420 |
| 4,544,986 | 10/1985 | Büchl | 123/90.11 |
| 4,572,114 | 2/1986 | Sickler | 123/90.13 |
| 4,589,627 | 5/1986 | Grotloh | 251/31 |
| 4,829,947 | 5/1989 | Lequesne | 123/90.11 |
| 4,841,923 | 6/1989 | Büchl | 123/90.11 |

FOREIGN PATENT DOCUMENTS

| | | | |
|---|---|---|---|
| 1116084 | 1/1956 | France | 92/131 |
| 2224656 | 4/1973 | France | 92/131 |
| 0138220 | 8/1983 | Japan | 123/90.12 |
| 0170414 | 9/1984 | Japan | 123/90.12 |
| 0259713 | 12/1985 | Japan | 123/90.12 |
| 0460551 | 1/1937 | United Kingdom | 92/131 |

*Primary Examiner*—Charles J. Myhre
*Assistant Examiner*—Weilun Lo
*Attorney, Agent, or Firm*—Evenson, Wands, Edwards, Lenahan & McKeown

[57] ABSTRACT

A hydraulically operating actuating device for a lift valve, in particular in an internal combustion engine, has a piston which is connected to the valve stem. The piston is positioned in a cylinder and separates two stroke spaces which are connectable, in each case via inlet and outlet openings which can be occluded by the piston, to a pump for the working fluid or a reservoir. In order to reduce the energy requirement of the actuating device, the two inlet openings, which in a central actuation range of the piston are open, are connected to one another directly by a line, and two springs which act in opposite directions and, in equilibrium, hold the piston in a central position relative to two end positions engage on the piston or valve stem.

7 Claims, 7 Drawing Sheets

HYDRAULICALLY OPERATING ACTUATING DEVICE FOR A LIFT VALVE

BACKGROUND AND SUMMARY OF THE INVENTION

The present invention generally relates to a hydraulically operating actuating device for a lift valve; and more particularly to a simplified actuating device, as compared to previously used actuating devices, which operates with a greatly reduced expenditure of energy.

An actuating device for a light valve is disclosed by German Published Unexamined Patent Application (DE-OS) No. 3,347,533. In the case of this actuating device, working fluid displaced from a cylinder by a piston during the movement of the lift valve is not used for performing work, with the result that energy generated by this movement is lost. This results in a very high energy requirement for actuation of the lift valve. Although it is stated in the above-referenced patent application that, for the purpose of energy recover, one side of the piston should alternately act as pump, it is not explained how this energy recovery should actually be carried out. Furthermore, in this actuating device an expensive control device is present, but this does not permit mutually independent control of different lift valves.

Accordingly, an object on which the invention is based is to operate a simplified actuating device, as compared to previously used actuating devices, with a greatly reduced expenditure of energy.

In the case of the actuating device designed in accordance with one advantageous embodiment of the present invention, the actuation movement of a piston associated with a lift valve is initiated by springs, which, in end positions, are stressed to differing degrees, a working fluid, which is under pressure, being pushed from one stroke space into the other. The potential energy stored in the springs at end positions of the piston are thus used for accelerating the piston and the lift valve and are recovered during braking. In addition, the energy of the working fluid is not lost during its expulsion from the stroke space, and therefore, the supply of energy from outside can be restricted to the replacement of energy losses, in particular frictional losses, while the energy required for accelerations is provided by energy recovery. A further advantage is produced in that the energy recovering braking of the piston and of the lift valve damps their movement and prevents a hard impact at the end position.

An arrangement and prestressing of the springs which is space saving and advantageous for the actuation movements of the lift valve is also provided.

According to advantageous features of preferred embodiments of the present invention, an energy saving control device is provided for the actuating device, with the aid of which each individual actuation movement of the lift valve is initiated, so that each of these actuation movements can be altered and matched to requirements.

Additionally, energy losses caused by mechanical and hydraulic friction can be replaced in a simple and inexpensive manner by feeding working fluid which is under pressure from the pressure source into a stroke space towards the end of a stroke movement, provision being made for a simultaneous removal of an identical quantity of working fluid from the other stroke space. As a result, only a small portion of the working fluid to be delivered into or out of a stroke space upon each stroke movement has to be delivered by the pressure source with the expenditure of energy.

Further, the arrangement and control of the outlet openings is particularly simple.

A considerable acceleration of the stroke movement of the lift valve in the opening direction can be achieved by means of the design of the actuating device according to further embodiments of the present invention, although some of the energy recovery has to be sacrificed.

Also, a simple and reliable device which brings the lift valve into a starting position necessary for normal operation is envisioned when the internal combustion engine is started.

Other objects, advantages and novel features of the present invention will become apparent from the following detailed description of the invention when considered in conjunction with the accompanying drawings.

DETAILED DESCRIPTION OF THE DRAWINGS

Figure 1:
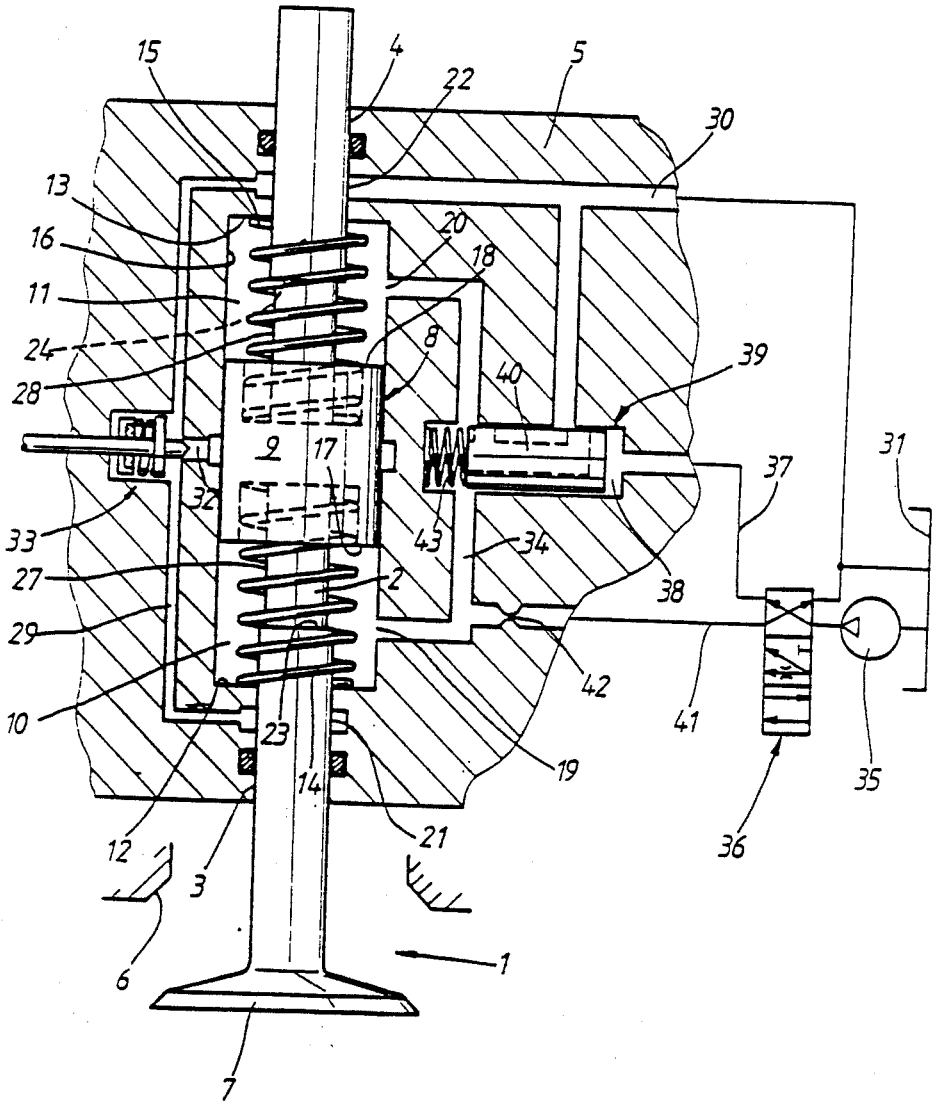
FIG. 1 shows a hydraulically operating actuating device of a lift valve in a housing of an internal combustion engine at the beginning of the starting procedure.

The lift valve 1 illustrated in all Figures is guided by a stem 2 in valve guides 3 and 4 in a housing 5 of an internal combustion engine which, except for a valve seat 6 for valve disc 7 of the lift valve 1, is not further illustrated. Between the two valve guides 3 and 4, the valve stem 2 passes through a cylinder 8, which forms a hollow space in the housing 5 and is divided by a piston 9 connected firmly to the valve stem 2 and guided in the cylinder 8 into a stroke space 10 near to the valve disc 7 and a stroke space 11 remote from the valve disc 7.

Two prestressed vehicle compression springs 14 and 15 which, when the actuating device is not operating, hold the piston 9 in a central rest position illustrated in FIG. 1 in which the valve disc 7 is spaced by a mean amount from the valve seat 6. The prestress of the compression springs 14 and 15 is defined such that, in the case of a position of the piston 9 near to one end face 12 or 13, the more remote compression spring 15 or 14 is virtually free of stress.

An inlet opening 19, 20 is, in each case, provided in the cylinder wall 16, approximately in the center between each cylinder end face 12, 13 of the cylinder 8 and that piston end face 17, 18 of the piston 9 which faces the cylinder end face when the piston is in its central position. These inlet openings 19, 20 are connected to one another by a connecting line 34 in the housing 5, with the result that the two stroke spaces 10 and 11 are connected to one another unless one of the two inlet openings 19, 20 is covered by the piston 9.

Figure 3:
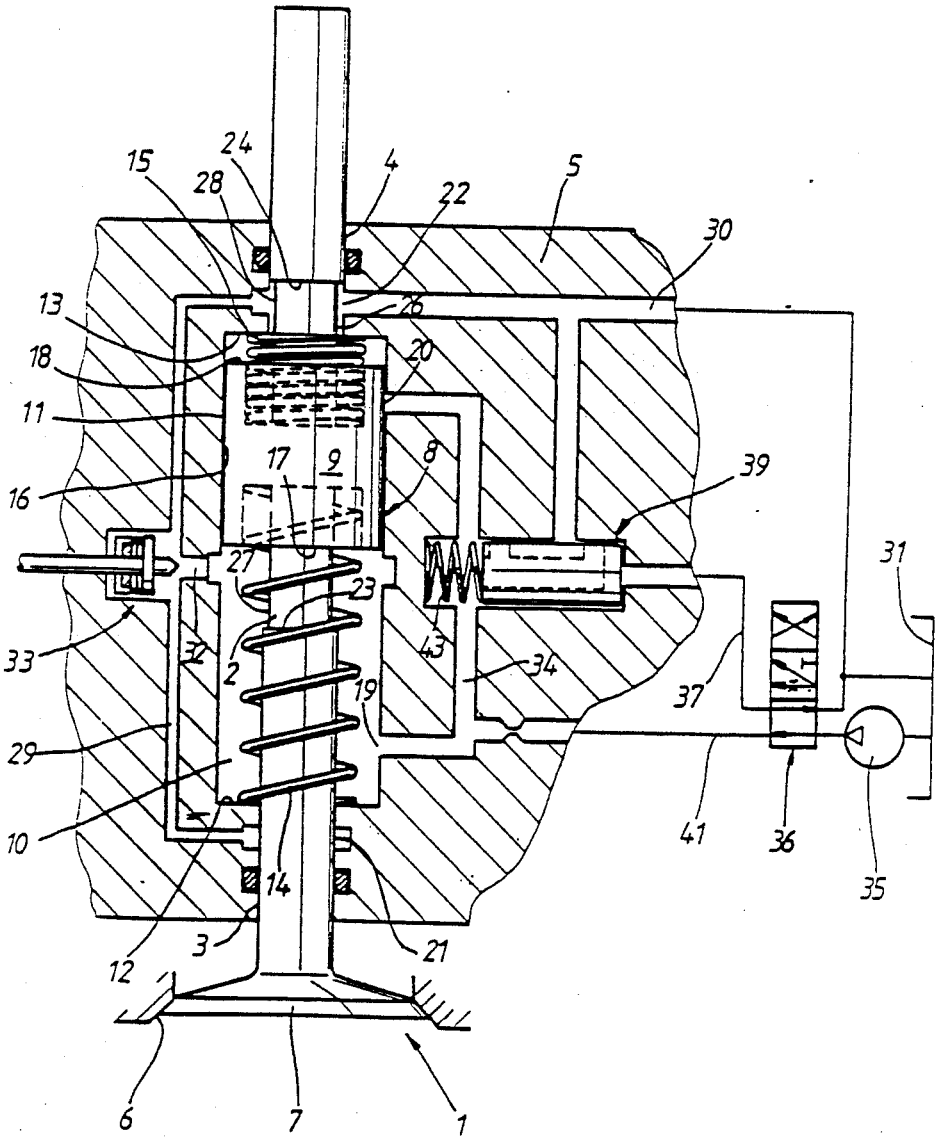
FIGS. 3 to 6 show the actuating device during various lift valve positions.

An outlet opening 21, 22 is furthermore provided in each valve guide 3, 4, each outlet opening 21, 22 being traversed by a shoulder 23, 24, respectively, in the valve stem 2 simultaneously with traversal of the neighboring inlet opening 19 or 20 by a piston end face 17 or 18, so that then in each case one stroke space 10, 11 is connected via an annular space 25, 26 (see FIGS. 3, 5 and 6) between the valve guide 3, 4 and the valve stem 2, which annular space 25, 26 is formed by a reduction 27, 28 in the valve stem 2 between the shoulder 23, 24 and the piston 9, via return lines 29 and 30 to a reservoir 31 for a working fluid.

A control line 32, which can be controlled, for example, by an electromagnetically actuatable control valve 33 and opens into the return line 29, extends from the cylinder wall 16 in the center of the cylinder height. If the piston 9 is near to an end wall 12 or 13, the pressure in either one of the stroke spaces 10 or 11 and hence the position and movement of the lift valve 1, for example the start or end of opening, can be influenced at will by this control line 32.

Figure 2:
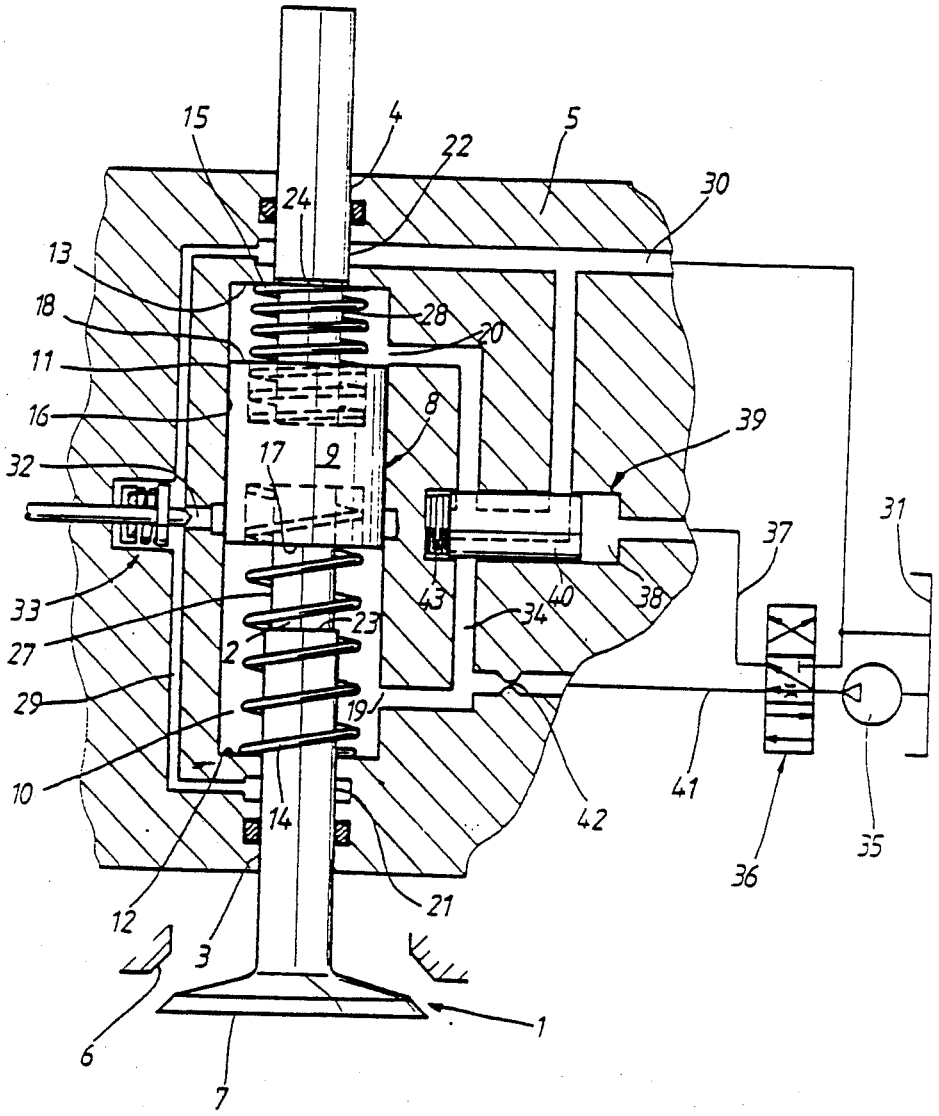
FIG. 2 shows the actuating device of FIG. 1 during the starting procedure.

The mode of operation of the hydraulically operating actuating device is described as follows. When the internal combustion engine is at a standstill, the piston 9 is held in a central position by the two compression springs 14, 15 and the lift valve 1 is partially open. When the internal combustion engine is started (FIG. 1), a pump 35, functioning as a pressure source for a working fluid, delivers from the reservoir 31, via a multi-way valve 36 and a line 37, the working fluid under pressure into a pressure space 38 of a starting valve 39, a slide 40 of which interrupts connecting line 34. By adjusting the multi-way valve 36, the pump 35 is connected in the further course of the starting procedure (FIG. 2), via the pressure line 41, in which there is a restrictor 42, to the part of the line 34 between the stroke space 10 near to the valve disc 7 and the starting valve 39. As a result, the pressure building up in this stroke space 10 displaces the lift valve 1 in a closing direction until the valve disc 7 rests against the valve seat 6.

During this procedure, the working fluid displaced in the stroke space 11 remote from the valve disc 7 can flow off via that part of the connecting line 34 which lies between the inlet opening 20 and the starting valve 39 and via the hollow-bored starting slide 40 and subsequently directly via the outlet opening 22 into return line 30 and the reservoir 31. In the closing position of the lift valve 1, the pressure space 38 of the starting valve 39 is connected by a further adjustment of the multi-way valve 36 (FIG. 3), via the line 37, to the reservoir 31, with the result that one compression spring 43 can push back the starting slide 40 and interruption of the connecting line 34 is cancelled.

During this procedure, the connection of the pump 35 to the connecting line 34 is maintained, with the result that the pressure prevailing in the stroke space 10 near to the valve disc 7 holds the lift valve 1 in the closing position against the force of the fully stressed compression spring 15 remote from the valve disc 7, the energy consumption of the pump 35 being low due to the non-delivery of the working fluid. The starting procedure is therewith ended.

Figure 4:
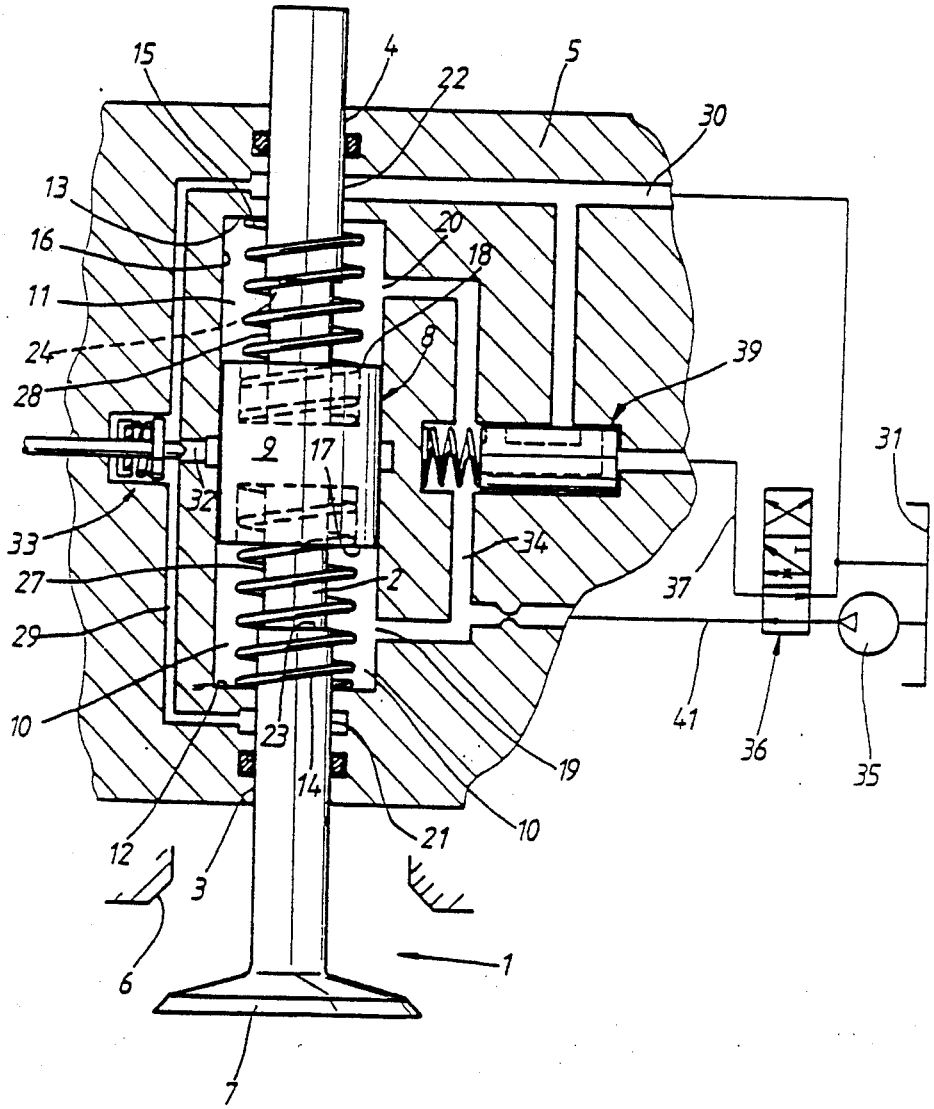

In order to initiate an opening movement of the lift valve 1, the control valve 33 is briefly opened (FIG. 3), so that working fluid can flow off via the control line 32 from the stroke space 10 near to the valve disc 7 and the pressure decreases in the stroke space 10. The compression spring 15 can now accelerate the piston 9 downwards together with the lift valve 1. After being traversed by the piston end face 17 the control line 32 is blocked by the piston or, if required, even earlier by a reclosure of the control valve 33 (FIG. 4). The piston 9 is accelerated as far as a central region of the cylinder 8 by the preponderant force of compression spring 15 and then braked by the preponderant force of compression spring 14. During this piston movement, while the inlet openings 19 and 20 are not occluded, the working fluid is pumped out of the stroke space 10 near to the valve disc 7, via the connecting line 34, into the stroke space 11 remote from the valve disc 7, with the result that the energy content of this working fluid is retained. The energy consumption of the pump 35 during this time is low since it is not delivering any working fluid.

Figure 5:
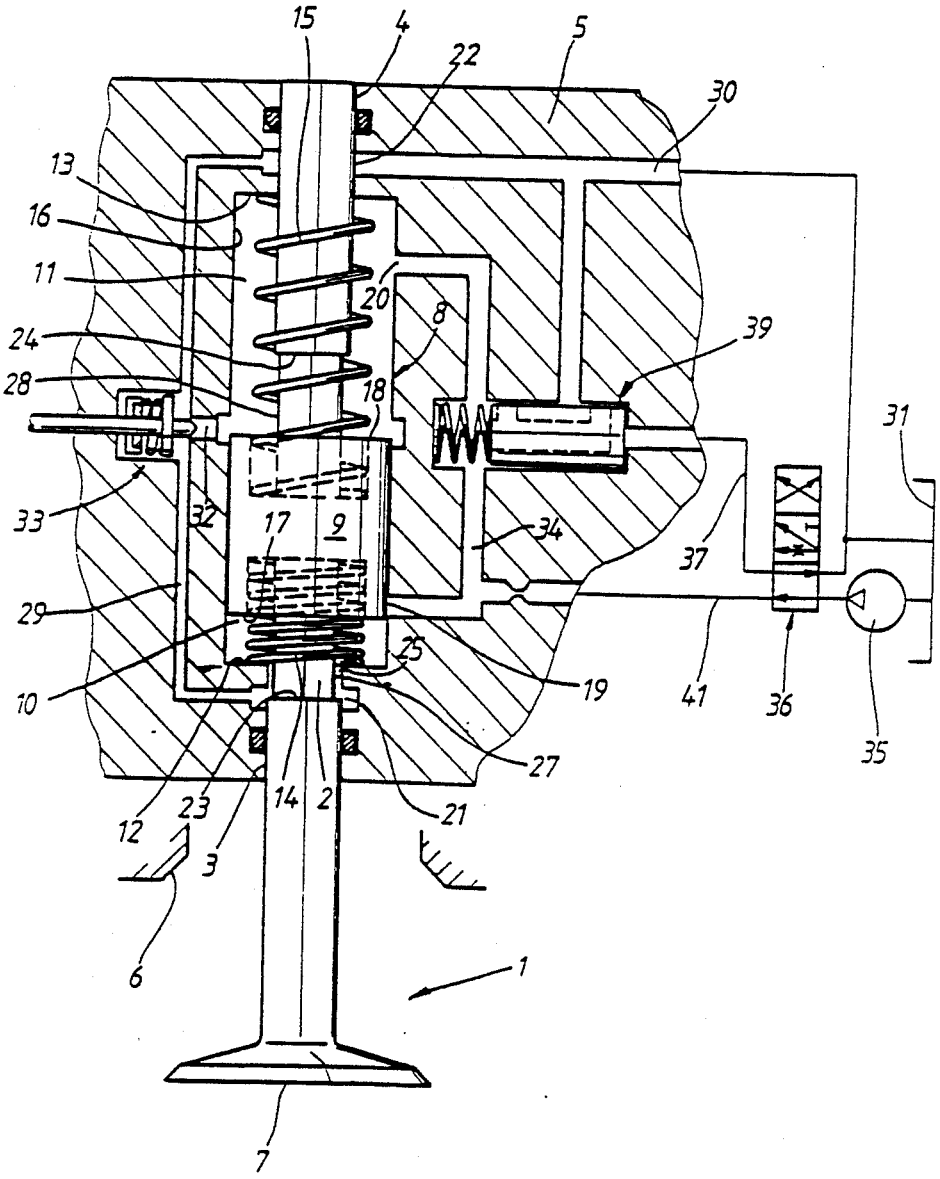
Figure 6:
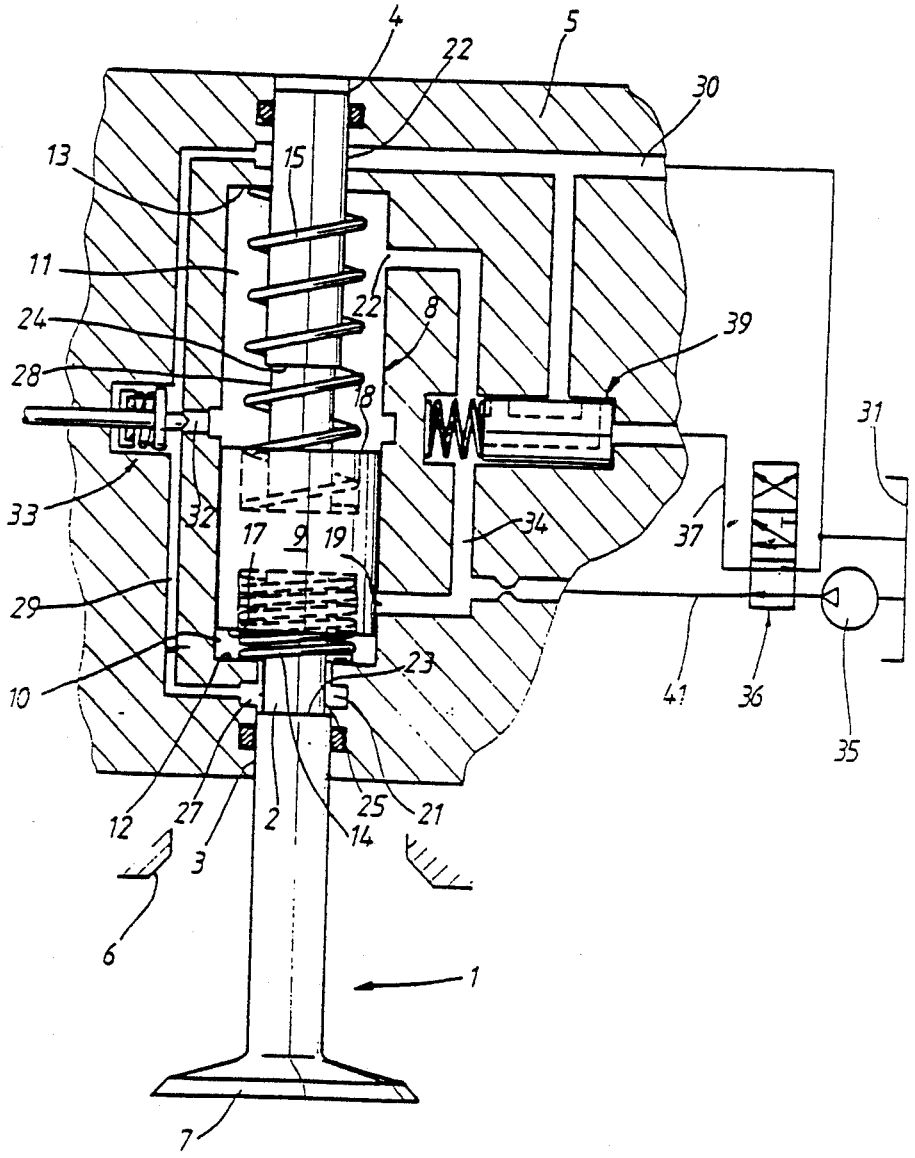

Before reaching the lower end position of the piston 9, the piston end face 17 traverses the inlet opening 19, so that the stroke space 10 is separated from the connecting line 34 (FIG. 5). The pump 35 now conveys working fluid into the stroke space 11 remote from the valve disc 7 and forces the piston 9 against the force of the compression spring 14 into a lower end position (FIG. 6), the frictional and pressure losses thereby being compensated. The working fluid displaced from the stroke space 10 near to the valve disc 7 during this piston movement flows off via the outlet opening 21, which is freed by the shoulder 23 of the valve stem 2 simultaneously with the closure of the inlet opening 19 by the piston 9.

Closing movement of the lift valve 1 proceeds, in a manner not specially illustrated in the drawing, exactly symmetrically to the opening movement. It is initiated by the opening of the control valve 33, so that the compression spring 14 near to the valve disc 7 accelerates the lift valve 1 towards the closing direction, pushing working fluid across from stroke space 11 to stoke space 10. The last path section up to the closing position, in which the valve disc 7 rests against the valve seat 6, is travelled by feeding working fluid from the pump 35 into the pressure space 10 near to the valve disc 7 after the inlet opening 20 has been covered by the piston 9 and the outlet opening 22 has been freed.

As a result, the external control of the actuating device outside the starting procedure is effected exclusively by the opening or closing of a single line, namely the control line 32, for which purpose a control valve 33 of only very simple construction is required which also has a very low energy requirement. Despite the simplicity of the control, a very substantial degree of influence can be exercised over the stroke movements of the lift valve. Since the start both of the opening movement and of the closing movement of the lift valve is initiated by an actuation of the control valve 33, not only the time of the start of opening and end of opening and hence also the duration of opening but also the stroke height of the lift valve 1 can be freely chosen if the control valve 33 is already opened again during the opening stroke, before the lift valve has reached its full opening position, and hence the closing stroke initiated.

Figure 7:
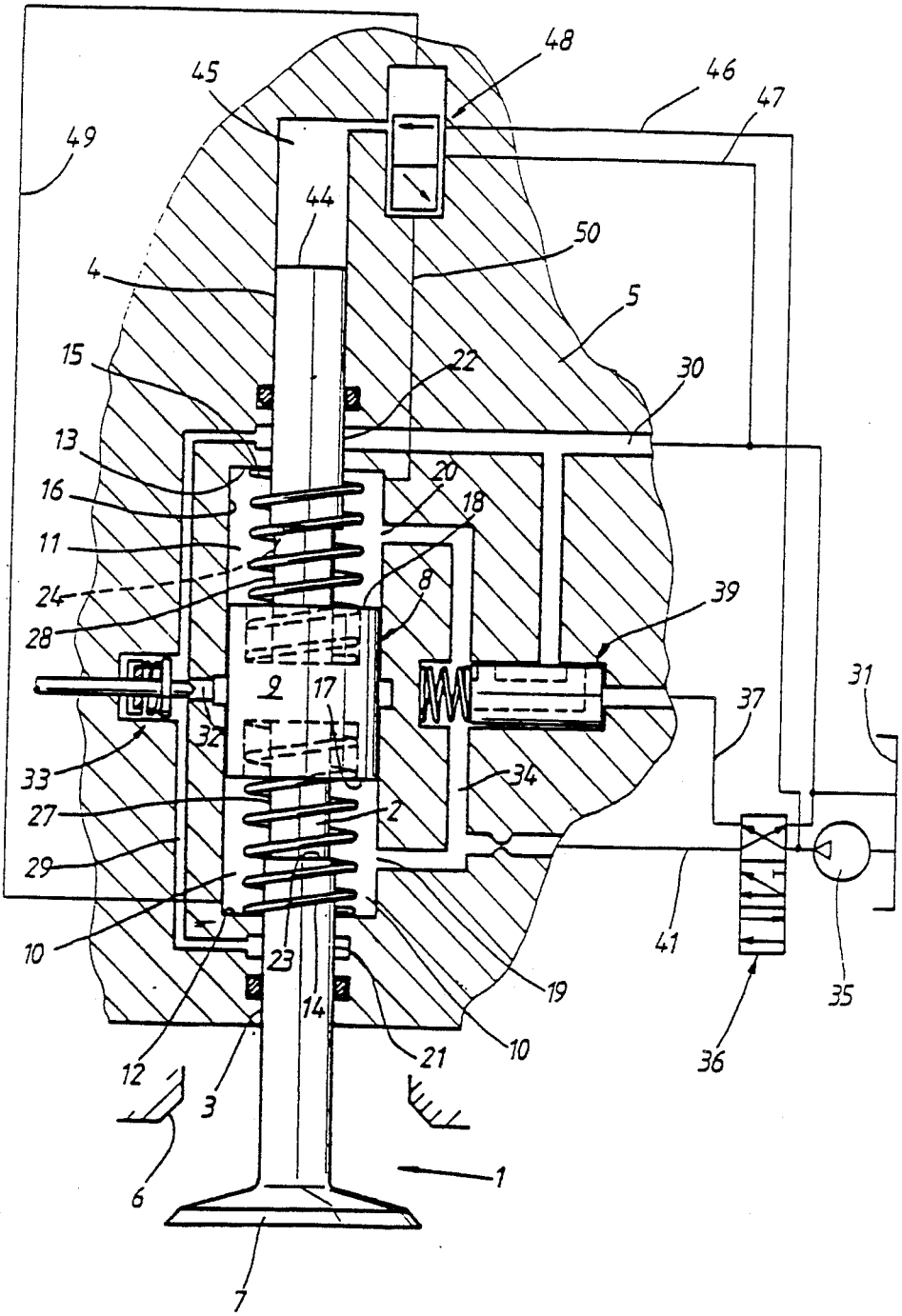
FIG. 7 shows an actuating device with additional displacement energy feed in the opening stroke.

As illustrated in FIG. 7, for accelerating the stroke movement, the lift valve 1 can be additionally stressed by working fluid at that end face 44 of the valve stem 2 which faces away from the valve disc 7. For this purpose, a stem stroke space 45 arranged in the housing 5 and adjoining the end face 44 can be connected via a pressure line 46 to the pump 35 and via a return line 47 to the reservoir 31, the connection being controlled by a two-way valve 48. The valve 48 is controlled via two control lines 49, 50 connected to the stroke spaces 10, 11 by the pressure differences prevailing in the stroke spaces 10, 11, in such a way that, in the case of a higher pressure in the stroke space 10 near to the valve disc 7, the pressure line 46 is connected to the stem stroke space 45 and, in the case of a higher pressure in the stroke space 11 remote from the valve disc 7, the return line 47 is connected to the stem stroke space 45. The opening movement of the stroke valve 1 is thus assisted and accelerated by the pressure of the working fluid acting on the end face 44 of the valve stem 2, while the closing movement of the lift valve 1 is not hindered.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Hydraulically acting actuating device for a lift valve, in particular, in an internal combustion engine, having a piston which is connected to a valve stem, said piston is guided in a cylinder and stressed on both sides by working fluid and divides two stroke spaces which are both connectable, via respective openings in a wall the cylinder which can be occluded by piston covering the openings, to a pressure source for pressurizing the working fluid and to a reservoir, wherein the respective openings, which in a central actuation range of the piston each communicate with an associated one of said stroke spaces, are connected to one another directly by a connecting line and wherein springs, which act in opposite directions and hold the piston in a central position in said central actuation range relative to two end positions when in equilibrium, engage on at least one of the piston and a cylinder end wall.

2. Actuating device according to claim 1, wherein the springs are compression springs, one of the springs being clamped in each stroke space between the piston and the cylinder end wall, and wherein the springs have a prestress in a central position of the piston so that a remote end position of the piston the springs are virtually free of stress.

3. Actuating device according to claim 2, wherein an outlet opening is provided in a central cylinder region, said outlet opening being connected to each stroke space only in end position regions of the piston and wherein a line connecting the outlet opening to the reservoir can be shut off by a control valve.

4. Actuating device according to claim 1, wherein each opening is arranged at a distance from an associated one of said cylinder end walls and, in one end position region of the piston is occluded by the piston and, simultaneously with the occlusion of the opening, an outlet opening associated with the same stroke space and connected to the reservoir is opened.

5. Actuating device according to claim 4, wherein the outlet openings are arranged in valve stem guides, and are occluded in the closed state of the valve stem and, in the opened state of the valve stem, communicating via a reduction in the valve stem with an associated stroke space.

6. Actuating device according to claim 5, wherein an end face of the valve stem, which faces away from a valve disc of the lift valve, is stressed by the working fluid, a connection to one of the pressure source and the reservoir being controlled by a two-way valve, a position of which is dependent on a pressure difference between the stroke spaces.

7. Actuating device according to claim 6, wherein, during a starting procedure, a connecting line connecting the openings is blocked by a slide stressed by the working fluid and wherein only a stroke space near to the valve disc is connected to the pressure source and only a stroke space remote from the valve disc is connected to the reservoir.

* * * * *